United States Patent [19]

Frost

[11] Patent Number: 4,694,789

[45] Date of Patent: Sep. 22, 1987

[54] VARIABLE VALVE TIMING

[75] Inventor: Derek Frost, Leigh-On-Sea, United Kingdom

[73] Assignee: Ford Motor Company, Dearborn, Mich.

[21] Appl. No.: 796,661

[22] Filed: Nov. 8, 1985

[30] Foreign Application Priority Data

Nov. 9, 1984 [GB] United Kingdom ..... 8428430

[51] Int. Cl.[4] ..... F01L 1/34; F16F 15/26

[52] U.S. Cl. ..... 123/90.17; 123/90.31; 123/90.6; 123/192 B; 74/604

[58] Field of Search ..... 123/90.15, 90.17, 90.6, 123/90.2, 90.31, 192 R, 192 B; 74/603, 604, 69

[56] References Cited

U.S. PATENT DOCUMENTS

| | | | |
|---|---|---|---|
| 1,495,620 | 5/1924 | Thomas | 123/90.31 |
| 2,248,528 | 7/1941 | Gordon et al. | 123/90.17 |
| 2,281,883 | 5/1942 | Kosian | 123/90.17 |
| 3,633,555 | 1/1972 | Raggi | 123/90.17 |
| 4,440,123 | 4/1984 | Tsai | 74/604 |
| 4,480,607 | 11/1984 | Tsai et al. | 74/604 |

FOREIGN PATENT DOCUMENTS

| | | | |
|---|---|---|---|
| 153908 | 9/1984 | Japan | 123/90.17 |
| 216599 | 6/1924 | United Kingdom | 123/90.31 |
| 649192 | 1/1951 | United Kingdom | 123/90.17 |

*Primary Examiner*—Ira S. Lazarus

*Attorney, Agent, or Firm*—Robert E. McCollum; Clifford L. Sadler

[57] ABSTRACT

The invention relates to a drive mechanism for connecting an input shaft to an output shaft and superimposing on the output shaft a variable oscillatory motion determined by the position of a reaction member. The drive mechanism comprises an input disc fast in rotation with the input shaft, and defining a slideway transverse to the axis of the input shaft. A sliding member is made to slide along the slideway by a block journalled within a pivotable yoke, the block being itself slidable in a second slideway defined by the sliding member. A crank pin fixed to the output shaft is connected slidably to the sliding member such that as the sliding member slides along the slideway, the phase of the output shaft is varied with respect of the phase of the input shaft. A second similar mechanism drives a weight with opposite phase in order to cancel out the reaction torque on the input shaft.

6 Claims, 2 Drawing Figures

VARIABLE VALVE TIMING

The present invention relates to variable valve timing.

In an internal combustion engine the optimum performance that can be obtained at a given engine speed depends on the angles at which the inlet and exhaust valves open and close. These angles vary as a function of speed and when designing an engine it is usual to arrive at a compromise whereby performance or efficiency is optimised at only one engine speed.

A proposal which has been made to overcome this problem is fully shown and described in U.S. Pat. No. 4,616,606 to vary the valve timing by superimposing upon the angular rotation of the cam shaft an oscillatory motion in order to advance then retard rotation of the cams within each cycle so as effectively to alter both the opening times of the associated valves and the rate at which the valves are opened and closed at any given engine speed.

It would be possible, but not commercially viable, to control each pair of valves of a cylinder individually but it is clearly more economical to operate on a single camshaft to vary the valve timing of all the cylinders of an engine. This however dictates that the frequency of oscillation must be a multiple of the camshaft speed, the factor depending on the number of cylinders in a block. Superimposing such a rapid oscillation on the camshaft, having regard both to the inertial mass of the camshaft and the spring forces of the individual valves, gives rise to very considerable loading and severe problems have been encountered in the past in designing a suitable drive mechanism capable of withstanding the stresses reliability.

Patent Application Specifications Nos. 2096695 and 2133465 both describe mechanisms in which an input shaft and an output shaft are connected to respective cranks, the two cranks engaging in a slot in a disc which is constrained by a yoke to rotate about an axis parallel to the input and output shafts but which is capable of being offset from their centre of rotation. As the disc is offset, an oscillation in superimposed on the rotation of the output shaft.

The second of the above two specifications relates to a method of guiding the movement of the slotted disc to ensure that it adopts a fail safe on axis position as engine speed rises or in the event of a failure of the hydraulic system controlling the position of the yoke.

The loading earlier mentioned can be withstood by the mechanism causing the oscillations but the powertrain connected to the input of the mechanism, usually in the form of a belt drive, cannot withstand these forces. It is furthermore not economical to replace such a toothed belt drive by means of gearing.

With a view to reducing this loading, it would be desirable to reduce the inertial forces by including a balance weight which is rotated at the same time as the mechanism but creating a reaction torque out of phase with the reaction torque of the camshaft so that the only loading placed upon the transmission would be caused by the springs. However, in the mechanism described in the previously mentioned patent specifications, the graph of torque versus cranking angle is not symmetrical and therefore the reaction torque cannot readily be balanced out by resorting to an inertial mass rotating in phase opposition.

The present invention seeks to provide a drive mechanism for connecting an input shaft to an output shaft and for superimposing on the output shaft a variable oscillatory motion determined by the position of a reaction member, in which mechanism the graph of the reaction torque versus the cranking angle is symmetrical.

In accordance with the present invention, the drive mechanism comprises means fast in rotation with one of the input and output shafts defining a slideway transverse to the axis of said one of the shafts, a sliding member slidable along said slideway, means for sliding the sliding member along the slideway in synchronism with the rotation of the input shaft, the amplitude of the sliding movement being dependent upon the position of the reaction member, the oscillation of the sliding member being symmetrical about a central position, and a crank pin fixed to the other of said input and output shafts and connected slidably to the said sliding member whereby as the sliding member slides along the slideway, the phase of the output shaft is varied with respect of the phase of the input shaft.

Conveniently, the means for oscillating the sliding member within the slideway comprises a second slideway formed in the sliding member transverse to the first slideway along which second slideway the reaction member is slidable.

In one embodiment of the invention, the reaction member may comprise a bearing rotatable within a stationary yoke and connected to a block which is slidable within the said second slideway.

In an alternative embodiment, the reaction member is a non rotatable cylinder the surface of which rolls along surfaces defining said second slideway as the input and output shafts rotate.

In the above described mechanism, because of the symmetry of the drive mechanism, the reaction torque on the transmission driving the input shaft are symmetrical and any inertial forces are therefore capable of being balanced out.

In a preferred embodiment of the invention, a balance weight is incorporated and driven in opposite phase with the oscillations superimposed on the output shaft so as to cancel out the reaction torque of the camshaft.

Though the counter balance weight may be driven by a second sliding member having two transverse slideways and analagous in operation to the previously described first sliding member, it is preferred that the balance weight be provided with a crank pin engaging in the same sliding member as the said other shaft but coupled to a slot arranged diametrically opposite the slot receiving the crank of the other shaft. The latter arrangement has the advantage that the balance weight may be arranged on the same side of the reaction member as the output and input shafts thereby permitting a more compact realisation of the drive mechanism.

The invention will now be described further, by way of example, with reference to the accompanying drawings in which.

Figure 1:
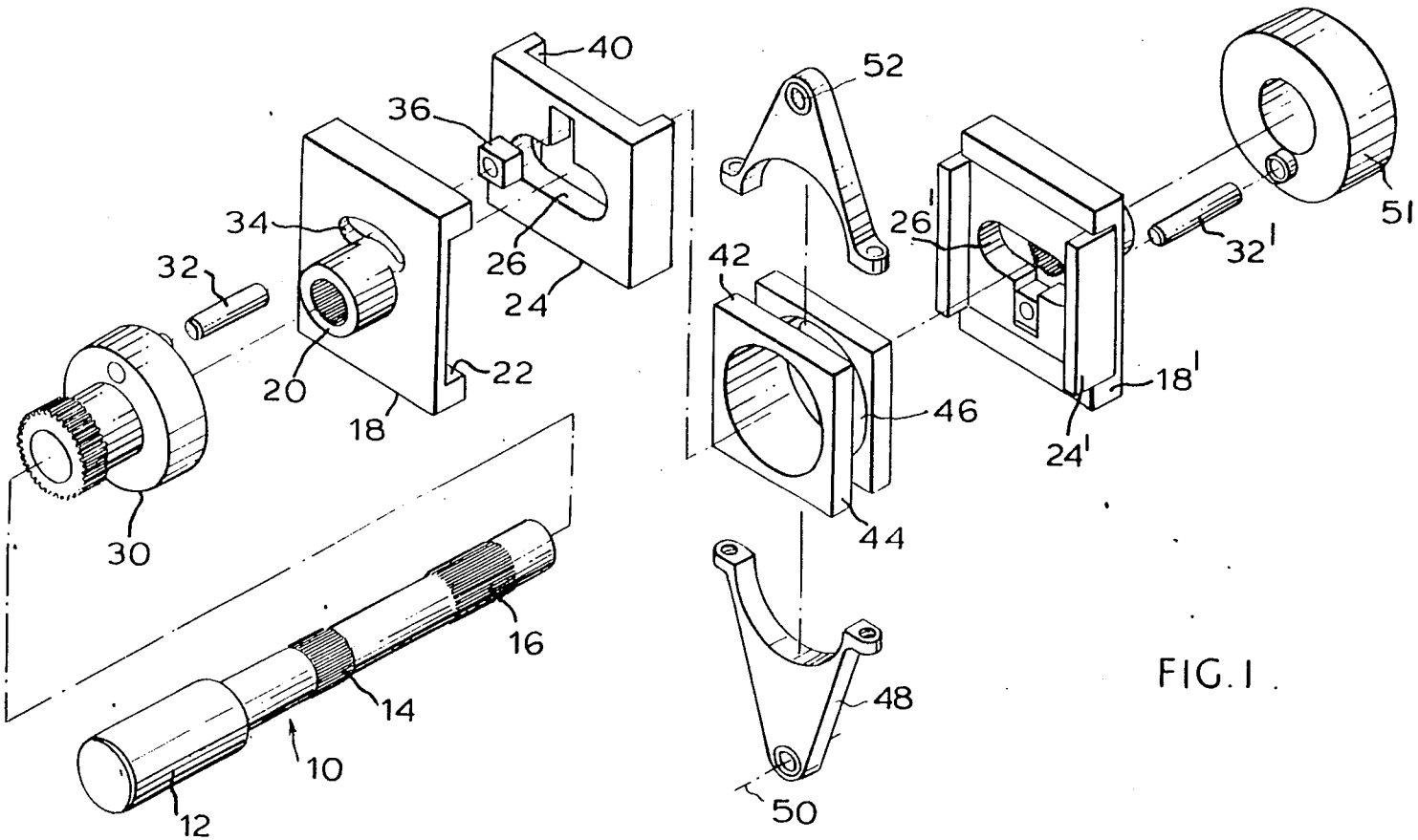
FIG. 1 is an exploded view of a first embodiment of the invention.

In FIG. 1, there is shown an input shaft 10 having a land 12 which is connectable to a drive pinion (not shown). The input shaft 10 is formed with two sets of splines 14 and 16. An input disc 18 has an internally splined boss 20 which engages with the first set of splines 14 so that the input disc 18 is fast in rotation with the input shaft 10.

On its opposite side from the boss 20, the input disc 18 is formed with a slideway 22 which receives a transverse sliding member 24. The sliding member 24 has a T-shaped slot 26 the cross bar of which has a width greater than the diameter of the input shaft 10 so that the sliding member 24 may move from side to side within the slideway 22 defined by the input disc 18. An output gear 30 is freely rotatably mounted about the land 12 on the input shaft 10 and has a crank pin 32 which passes through an arcuate slot 34 formed in the input disc 18 and is received in a block 36 which is free to slide radially in the upright of the T-shaped slot 26.

It will be appreciated that the splines 14, 20, the coupling between the transverse sliding member 24 and input disc 18, and the further coupling between the slot 26 and the crank pin 32 form a transmission train to cause the input shaft to rotate with the output shaft. Furthermore, if the input shaft 10 is stationary, sliding of the tranverse sliding member 24 to the left and to the right as viewed has the effect of altering the phase or angular relationship between the input shaft 10 and the output gear 30 so that if the sliding member 24 is made to oscillate within its slideway 22, the output gear 30 is made to undergo oscillation. The crank pin 32, being affixed to the output gear 30, assures that the length of the crank lever remains constant as the sliding member 24 moves in its slideway 22.

In order to achieve a mechanism which superimposes an oscillatory motion as the output gear 30 rotates at the same speed as the input shaft 10, it is necessary to oscillate the sliding member 24 during the course of the rotation of the input shaft 10. This is achieved in that the sliding member 24 incorporates a second slideway 40 which extends at right angles to the first slideway 22 and receives a block 42 having bearing surfaces 44 slidable within the slideway 40, a cylindrical bearing surface 46 which is received within a split yoke 48 mounted for pivoting about an axis at its lower end 50, the upper end of the yoke 52 being connected to a control arm (not shown) which may for example be part of a hydraulic control mechanism.

Though the embodiment described above proposes a split yoke 48, it is alternativey possible for the yoke to be formed in one piece and for the block 42 to be split along an axial plane and to be journaled about a cylindrical surface defined by a one-piece yoke.

It will be seen from FIG. 1 that the arrangement is generally symmetrical about the yoke and on the opposite side there is a generally similar arangement comprising a second transverse sliding member 24' slidable in a slideway of a second input disc 18' splined to splines 16 on input shaft 10, the second sliding member 40' driving a balance weight 51 by way of a crank pin 32'. It is not deemed necessary to describe the second part of the mechanism in detail as its operation is analagous to that of the previously described parts. It is however important to notice that the T-shaped slot 26' of the second sliding member 24' is inverted with respect to that of the first sliding member 24 so that the counter balance weight 51 and the output gear 30, though both driven at the same speed as the input shaft 10 have superimposed on them oscillations which are out of phase with one another.

In the arrangement as illustrated, there is a drive to the balance weight 51 both through the spline 16 and through the block 42. These are not both necessary and it is only important to provide one or the other of these two drive means.

Thus, instead of the block 42 having bearing surfaces 44 engagable in the slideway 40 of the transverse slider 24 so that the block 42 rotates with the input shaft 10, it is possible for the reaction surface to be a cylinder which rolls on the sides of the slideway 40. In this case no torque would be transmitted through the reaction member constituted by the block 42 and it would be essential to provide the second spline 16 on the input shaft 10.

Figure 2:
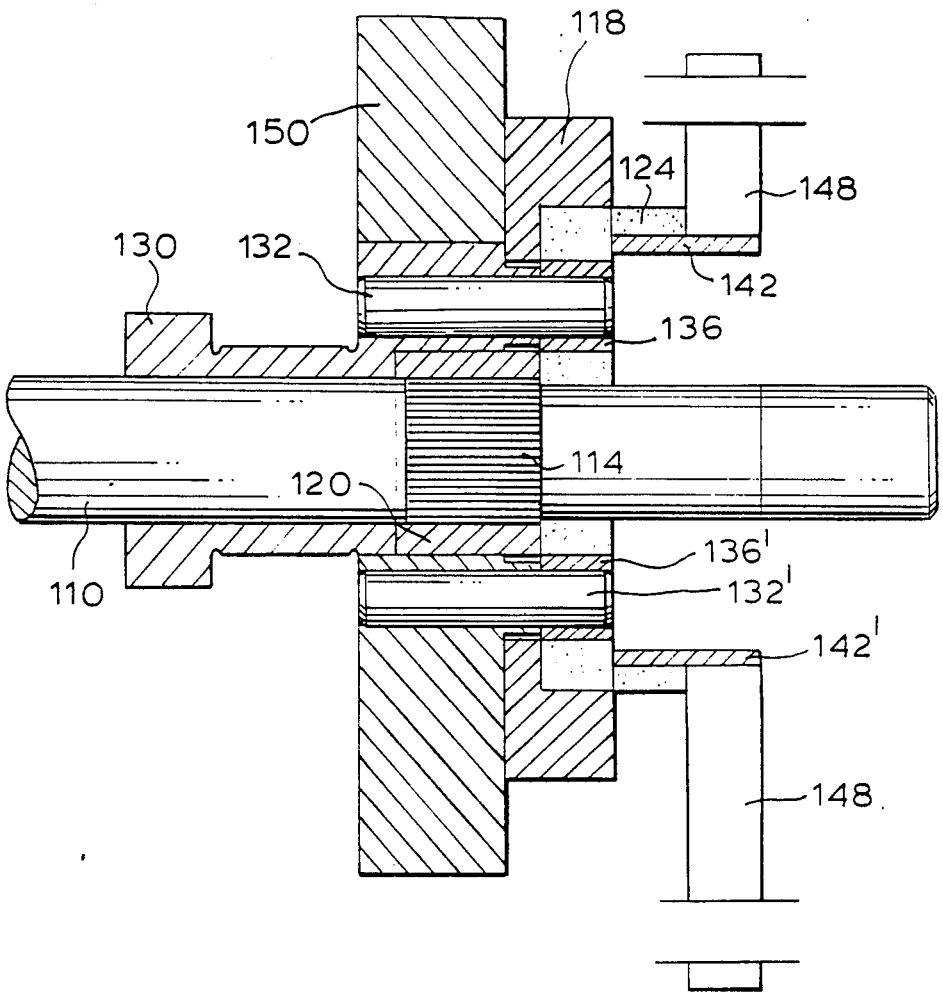
FIG. 2 is a section through a second and preferred embodiment of the invention.

In the embodiment of FIG. 1, the symmetry results in an unnecessary duplication of components. In the embodiment of FIG. 2, the balance weight is driven directly from the same sliding member 40 as the output gear 30 but from a point arranged diametrically opposite the crank pin connected to the output gear. The sliding member has a cruciform slot in place of the T-shaped slot 26 of the first embodiment and the balance weight has an additional arcuate slot to permit passage of the crankpin connected to the output gear. The principle of operation is otherwise the same as for the first embodiment.

In FIG. 2 the input shaft 110 has a single spline 114 which engages with an internally splined boss 120 of an input disc 118. A transverse sliding member 124 can slide in a slideway in the input disc 118 and itself has a slideway which rolls about a reaction member 142. The reaction member 142 is a cylinder mounted on a yoke 148 which is pivotable to move the reaction member from an on-axis position in which the output gear 130 rotates with constant speed into an off-axis position in which an oscillation is superimposed on the rotation of the output gear 130. Depending on the extent that the reaction member 142 is off-axis, the sliding member 124 is forced to slide relative to the input disc 118 as the input shaft 110 rotates. The lateral movement of the sliding member 124 is transmitted through a first slide block 136 and crank pin 132 to the output gear 130 and through a second sliding block 136' and crankpin 132' to the balance weight 150. The two crankpins are opposite one another in the leg of the crucifix slot so that acceleration of the balance weight 150 occurs at the same time as retardation of the output gear 130, so that the reaction torque on the sliding member 124 is negligible if the moment of inertia of the balance weight 150 is matched to that of the camshaft driven by the output gear 130.

It is expected that when used in an internal combustion engine to alter effective valve timing, the cam profiles will be designed such that the maximum oscillation of the camshaft will occur at idling speed and as engine speed increases, the raction member will be moved into the on-axis position. Thus at high engine speeds, the reaction torques will be negligible.

It is important to ensure that the engine speed should not be allowed to increase while the reaction member is in an off-axis position as the stresses could cause irreversible damage. Conveniently, therefore, the reaction member is urged by a strong spring (not shown) into a safe position, and the control means act to displace the yoke into an off-axis position at low engine speeds. In this way, the yoke automatically adopts a safe position in the event of a fault in the control means, which may for example be a hydraulic arm controlled electronically from a micro-computer.

I claim:

1. A drive mechanism for connecting an input shaft to an output shaft for rotation at the same speed while superimposing on the output shaft a variable oscillatory motion determined by the position of a reaction member, the drive mechanism comprising means fast in rotation with one of the input and output shafts defining a slideway transverse to the axis of said one of the shafts, a sliding member slidable along said driveway, means for sliding the sliding member along the slideway in synchronism with the rotation of the input shaft, the amplitude of the sliding movement varing as a function of the position of the reaction member, the oscillation of the sliding member being symmetrical about a central position, and a crank pin fixed to the other of said input and output shafts and connected slidably to the said sliding member whereby as the sliding member slides along the slideway, the phase of the output shaft is varied with respect to the phase of the input shaft.

2. A drive mechanism as claimed in claim 1, wherein the means for oscillating the sliding member within the slideway comprises a second slideway formed in the sliding member transverse to the first slideway along which second slideway the reaction member is slidable.

3. A drive mechanism as claimed in claim 2, wherein the reaction member comprises a bearing rotatable within a stationary yoke and connected to a block which is slidable within the said second slideway.

4. A drive mechanism as claimed in claim 2, wherein the reaction member is a non rotatable cylinder the surface of which rolls along surfaces defining said second slideway, as the input and output shafts rotate.

5. A drive mechanism as claimed in any one of the preceding claims, wherein a balance weight is incorporated and driven in opposite phase with the oscillations superimposed on the output shaft so as to cancel out the reaction torque of the camshaft.

6. A drive mechanism as claimed in claim 5, wherein the balance weight is provided with a crank pin engaging in the same sliding member as the said other shaft but coupled to a slot arranged diametrically opposite the slot receiving the crank of the other shaft.

* * * * *